US006121209A

United States Patent [19]

Watts et al.

[11] Patent Number: 6,121,209

[45] **Date of Patent: *Sep. 19, 2000**

[54] SYNERGISTIC ANTIOXIDANT SYSTEMS

[75] Inventors: Raymond Frederick Watts, Long Valley; Ricardo Alfredo Bloch, Scotch Plains, both of N.J.

[73] Assignee: Exxon Chemical Patents INC, Linden, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,557

[22] Filed: Jun. 4, 1997

Related U.S. Application Data

[63] Continuation of application No. 08/660,631, Jun. 7, 1996, abandoned, which is a continuation of application No. 08/353,013, Dec. 9, 1994, abandoned.

[51] Int. Cl.[7] ..... C10M 125/24; C10M 133/12

[52] U.S. Cl. ..... 508/162; 508/192; 508/280; 508/563; 252/75

[58] Field of Search ..... 508/280, 162

[56] References Cited

U.S. PATENT DOCUMENTS

| | | | |
|---|---|---|---|
| 3,026,262 | 3/1962 | Foster et al. | 508/162 |
| 3,236,774 | 2/1966 | Thompson et al. | 508/162 |
| 3,254,025 | 5/1966 | LeSuer | 508/192 |
| 3,696,851 | 10/1972 | Randell | 508/280 |
| 3,873,374 | 3/1975 | Kolts | 508/162 |
| 3,900,410 | 8/1975 | Malec | 508/280 |
| 4,268,404 | 5/1981 | Ahlgrim et al. | 508/162 |
| 4,428,849 | 1/1984 | Wisotsky | 252/33.4 |
| 4,514,312 | 4/1985 | Root et al. | 508/162 |
| 4,612,127 | 9/1986 | Uematsu et al. | 508/162 |
| 4,675,121 | 6/1987 | Root et al. | 508/162 |
| 4,692,258 | 9/1987 | Rasberger et al. | 252/50 |
| 4,769,164 | 9/1988 | Salomon | 252/48.2 |
| 4,857,214 | 8/1989 | Papay | 252/32.5 |
| 4,900,459 | 2/1990 | Ohmori et al. | 508/162 |
| 5,102,567 | 4/1992 | Wolf | 252/515 A |
| 5,185,090 | 2/1993 | Ryer | 252/46.6 |
| 5,242,612 | 9/1993 | Ryer et al. | 252/46.7 |
| 5,268,113 | 12/1993 | Evans | 252/515 R |
| 5,314,633 | 5/1994 | Ryer et al. | 252/46.7 |
| 5,326,487 | 7/1994 | Ryer et al. | 252/46.7 |
| 5,328,619 | 7/1994 | Conary | 252/32.5 |
| 5,534,170 | 7/1996 | Watts | 508/161 |
| 5,681,506 | 10/1997 | Pragnell et al. | 508/280 |
| 5,750,476 | 5/1998 | Nibert | 508/291 |
| 5,840,662 | 11/1998 | Nibert | 508/291 |

FOREIGN PATENT DOCUMENTS

| | | | |
|---|---|---|---|
| 0492934-B1 | 7/1992 | European Pat. Off. | C10M 159/12 |
| 0622444 | 11/1994 | European Pat. Off. . | |
| 0622444-A1 | 11/1994 | European Pat. Off. | C10M 125/24 |
| 2257158 | 1/1993 | United Kingdom | C10M 129/04 |

OTHER PUBLICATIONS

Smalheer et al, "Lubricant Additives", pp. 1–11, 1967.

*Primary Examiner*—Ellen M. McAvoy

[57] ABSTRACT

The invention provides synergistic combinations of phosphorus acid-containing compounds with ashless antioxidants. These combinations dramatically improve the oxidation stability of lubricating compositions, particularly power transmission fluids such as automatic transmission fluids.

11 Claims, No Drawings

SYNERGISTIC ANTIOXIDANT SYSTEMS

This is a continuation, of application Ser. No. 08/660,631, filed Jun. 7, 1996, now abandoned, which is a R. 62 continuation of U.S. Ser. No. 08/353,013, filed Dec. 9, 1994 (now abandoned).

BACKGROUND OF THE INVENTION

1. Field of the Invention

This invention relates to synergistic additive combinations which dramatically improve the oxidation stability of lubricating compositions, particularly automatic transmission fluids ("ATF").

2. Description of Related Art

Protection of lubricating compositions from oxidation is an increasingly important function of additive compositions. Merely increasing the treat rate of known conventional antioxidants is frequently insufficient to meet the higher requirements imposed by automobile manufacturers. Thus, there is a continuing search for alternate additives that confer greater oxidation stability to the lubricating composition. This invention is one method toward satisfying this need. We have found that a combination of phosphoric acid with ashless antioxidants, such as alkylated diphenyl amines and hindered phenols, surprisingly increases the oxidation resistance of a lubricating composition compared with either type of component alone.

SUMMARY OF THE INVENTION

One embodiment of this invention relates to a lubricating oil composition comprising a major amount of a lubricating oil and an oxidation-resistant effective amount of an additive combination of:

(A) a phosphoric acid-containing compound, or its total or partial sulfur analogs; and (B) an ashless antioxidant.

Another embodiment of this invention includes a concentrate containing the additive combination of this invention. Yet another embodiment is a method of improving the oxidation resistance of a lubricating composition by incorporating this invention's additive combination.

DETAILED DESCRIPTION OF THE INVENTION (A) The Phosphoric Acid-Containing Compound The phosphoric acid can be added in any form, for example, neat, an aqueous solution (e.g. 85% $H_3PO_4$), a complex with alcohols or ethers, or an amine salt. Partial and total sulfur analogs may also be used. The phosphoric acid, or thio analog, can be added to an additive package concentrate or directly to a lubricating composition. The phosphoric acid may also be produced in situ by any of a variety of known reactions.

(B) Ashless Antioxidants

The ashless antioxidants of the present invention are well known to persons skilled in the art. They generally are within into the following two classes, but are not limited to these classes.

i) Aromatic Amines

Suitable aromatic amines antioxidants include aromatic triazoles, phenothiazines, diphenylamines, alkyl diphenylamines containing 1 or 2 alkyl substituents each having up to about 16 carbon atoms, phenyl-α-naphthylamines, phenyl-β-naphthylamines, alkyl- or aralkyl-substituted phenyl-α-naphthylamines containing 1 or 2 alkyl or aralkyl groups each having up to about 16 carbon atoms, alkyl- or aralkyl-substituted phenyl-β-naphthylamines containing 1 or 2 alkyl or aralkyl groups each having up to about 16 carbon atoms, and similar compounds.

A preferred type of aromatic amine antioxidant is an alkylated diphenylamine of the general formula

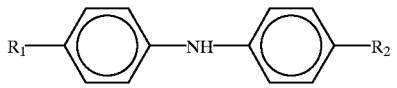

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L®, a material which is believed to be predominantly a 4,4'-dinonyldiphenylamine (i.e, bis(4-nonylphenyl)amine) wherein the nonyl groups are branched. Another preferred commercially available compound is Irganox L-57®, which is believed to be di-isooctyl diphenyl amine.

ii) Hindered Phenols

Suitable hindered phenol antioxidants include ortho-alkylated phenolic compounds such as 2,6-di-tert-butylphenol, 4-methyl-2,6-di-tert-butylphenol, 2,4,6-tri-tert-butylphenol, 2-tert-butylphenol, 2,6-di-isopropylphenol, 2 methyl-6-tert-butyl-phenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-di-styryl-4-nonylphenol, and their analogs and homologs. Mixtures of two or more such mononuclear phenolic compounds are also suitable.

Other suitable hindered phenols are butylated hydroxy toluene (BHT), butylated hydroxy anisole (BHA), and their derivatives.

The preferred hindered phenol antioxidants for use in this invention are methylene bridged alkylphenols, which can be used singly or in combinations with each other, or in combinations with sterically-hindered unbridged phenolic compounds. Illustrative methylene bridged compounds include 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylenebis(2,6-di-tert-butylphenol), and their derivatives.

iii) Other Antioxidants

While the aromatic amine and hindered phenol antioxidants are particularly useful in this invention, the foregoing description is not intended to limit other available antioxidants. Thus, other types of antioxidants may be used as part of this invention alone or in combination with the aromatic amine and hindered phenol antioxidants.

The additive combination of the present invention is typically used in power transmission fluids such as automatic transmission fluids. The typical treat rate of the phosphoric acid in the fluid is such that the fluid contains from 10 to 1000 ppm phosphorus. The treat rate of ashless antioxidant, or mixture of ashless antioxidants, can vary quite broadly, but is generally in a weight ratio of ashless antioxidant to phosphoric acid of 50:1 to 1:50, preferably 10:1 to 1:10, although ratios outside these ranges could be used.

This invention may be added to a lubricating oil basestock in an amount sufficient to impart antioxidancy properties. Typically, this will correspond to a range of 0.05 to 1.0 weight percent of 100% active ingredient, preferably 0.4 to 0.8 weight percent, most preferably 0.5 to 0.7 weight percent. The preferred range corresponds to approximately 0.02 to 0.04 mass percent phosphorus in the oil.

Desirably, a source of boron is present in the lubrication oil basestock together with the additive combination of this invention. The presence of boron tends to lessen the deterioration of silicone-based seals. The boron source may be present in the form of borated dispersants, borated amines, borated alcohols, borated esters, or alkyl borates.

Accordingly, by adding an effective amount of this invention's additive combination to a lubricating oil and then placing the resulting lubrication oil within a lubrication system, the oil will inhibit oxidation of the lubrication fluid.

The lubrication oil basestock may contain one or more additives to form a fully formulated lubricating oil. Such lubricating oil additives include corrosion inhibitors, detergents, pour point depressants, antioxidants, extreme pressure additives, viscosity improvers, friction modifiers, and the like. These additives are typically disclosed in, for example, "Lubricant Additives" by C. V. Smalheer and R. Kennedy Smith, 1967, pp. 1–11 and in U.S. Pat. No. 4,105,571, the disclosures of which are incorporated herein by reference. A fully formulated lubricating oil normally contains from about 1 to about 20 weight % of these additives. Borated or unborated dispersants may also be included as additives in the oil, if desired. However, the precise additives used (and their relative amounts) will depend upon the particular application of the oil. Contemplated applications for formulations of this invention include gear oils, industrial oils, lubricating oils, and power transmission fluids, especially automatic transmission fluids. The following list shows representative amounts of additives in lubrication oil formulations:

| Additive | (Broad) Wt. % | (Preferred) Wt. % |
|---|---|---|
| VI Improvers | 1–12 | 1–4 |
| Corrosion Inhibitor/ Passivators | 0.01–3 | 0.01–1.5 |
| Dispersants | 0.10–10 | 0.1–8 |
| Anti-Foaming Agents | 0.001–5 | 0.001–1.5 |
| Detergents | 0.01–6 | 0.01–3 |
| Anti-Wear Agents | 0.001–5 | 0.001–1.5 |
| Pour Point Depressants | 0.01–2 | 0.01–1.5 |
| Seal Swellants | 0.1–8 | 0.1–6 |
| Friction Modifiers | 0.01–3 | 0.01–1.5 |
| Lubricating Base Oil | Balance | Balance |

Particularly suitable detergent additives for use with this invention include ash-producing basic salts of Group I (alkali) or Group II (alkaline) earth metals and transition metals with sulfonic acids, carboxylic acids, or organic phosphorus acids.

The additive combination of this invention may also be blended to form a concentrate. A concentrate will generally contain a major portion of the combination together with other desired additives and a minor amount of lubrication oil or other solvent. The combination and desired additives (i.e., active ingredients) are provided in the concentrate in specific amounts to give a desired concentration in a finished formulation when combined with a predetermined amount of lubrication oil. The collective amounts of active ingredient in the concentrate typically are from about 0.2 to 50, preferably from about 0.5 to 20, most preferably from 2 to 20 weight % of the concentrate, with the remainder being a lubrication oil basestock or a solvent.

The additive combination of this invention may interact with the amines contained in the formulation (i.e., dispersant, friction modifier, etc.) to form quaternary ammonium salts. The formation of amine and quaternary ammonium salts, however, will not adversely affect antioxidant characteristics of this invention.

Suitable lubrication oil basestocks can be derived from natural lubricating oils, synthetic lubricating oils, or mixtures thereof. In general, the lubricating oil basestock will have a viscosity in the range of about 5 to about 10,000 $mm^2/s$ (cSt) at 40° C., although typical applications will require an oil having a viscosity ranging from about 10 to about 1,000 $mm^2/s$ (cSt) at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers, and their derivatives where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicone-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydroforans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

This invention may be further understood by reference to the following examples which are not intended to restrict the scope of the appended claims.

EXAMPLES

To demonstrate this invention, a series of lubricating oil test formulations were blended and tested according to the Ford Aluminum Beaker Oxidation Test ("ABOT") described in the Ford MERCON Specification Aug. 24, 1992 revision). All of the formulations contained a basestock and conventional amounts of borated and unborated succinimide dispersants, tolyltriazole, amide and ethoxylated amine friction modifiers, viscosity modifier, and antifoamant. The basestock used was an oxidatively weak solvent extracted neutral oil blended to approximately an 80 neutral number.

The ABOT results for the six prepared test formulations, A–F, are shown in Table 1. All phosphorus containing formulations were formulated to approximately 200 ppm phosphorus, and the antioxidants were used at conventional levels as shown. The Ford ABOT passing limits are also shown for reference purposes.

TABLE 1

| | FORD ABOT RESULTS (Based on 250 Hours) | | | | | |
|---|---|---|---|---|---|---|
| FORMULATIONS | A | B | C | D | E | F |
| PHOSPHORUS SOURCE | NONE | $H_3PO_4$ | $H_3PO_4$ | $H_3PO_4$ | $H_3PO_4$[1] | TPP |
| PPM PHOSPHORUS | 0 | 224 | 221 | 214 | 207 | 191 |
| ANTIOXIDANT CONCENTRATION, | A-DPA | NONE | A-DPA | PHENOLIC | A-DPA | A-DPA |
| CONCENTRATION, WT. % | 0.3 | 0 | 0.3 | 0.5 | 0.3 | 0.3 |
| TEST RESULTS (FORD LIMITS) | | | | | | |
| DELTA TAN (<4.0) | 7.0 | 4.8 | 1.2 | 3.1 | 1.3 | 3.1 |
| DELTA KV40 (<40) | 179 | 57 | 2 | 33 | 7 | 28 |
| % IR CHANGE (<40) | 79 | 75 | 33 | 51 | 38 | 38 |
| PENTANE INSOLUBLES (<1.0) | 6.7 | 3.1 | 0.16 | 0.53 | 0.23 | 0.42 |

Notes:
[1]COMPLEX WITH THIOBISETHANOL
A-DPA = DI-NONYL-DIPHENYLAMINE
PHENOLIC = 4,4"-METHYLENE BIS 2,6-DI-t-BUTYL PHENOL
TPP = TRIPHENYL PHOSPHITE Formulations A and B are the base comparative formulations, i.e., they do not contain the synergistic combination of the present invention. As seen in Table 1, both of these formulations did not meet the Ford requirements. For example, Fluid A has a Delta TAN (increase in total acid number) of 7.0 and Fluid B a TAN increase of 4.8. Ford requires a TAN increase of less than 4.0. Both of these fluids fail the remainder of the Ford requirements quite substantially as well.

Fluids C and D contain the synergistic mixture of the present invention. Both fluids have had phosphoric acid (85%) added to the additive during blending. Fluid C contains a commercial alkylated diphenyl amine antioxidant, and Fluid D contains a commercial hindered phenol antioxidant. Fluid C meets all of the Ford requirements easily. Fluid D meets all but the % IR change requirement. However, the data shows that both Fluids C and D are significant improvements in antioxidancy over Fluids A and B.

Fluid E is the same as Fluid C except the phosphoric acid (85%) was added as a complex with thiobisethanol. Fluids C and E give essentially the same results in the Ford test showing that the method of addition of phosphoric acid is not important.

Fluid F contains 200 ppm of phosphorus delivered by using triphenyl phosphite. Fluid F also contains the alkylated diphenyl amine antioxidant. While fluid F also passes the Ford requirements, when compared to Fluids C and E, Fluid F is poorer in oxidation resistance, showing that the best synergy is gained when using phosphoric acid, not triphenyl phosphite.

The foregoing examples surprisingly demonstrate that there is a dramatic improvement in oxidation resistance of the fluid when the synergistic combination of phosphoric acid and ashless antioxidants is used.

While preferred embodiments of this invention have been described herein, the principals of the invention are contemplated to include other embodiments, particularly those using other inorganic phosphorus-containing acids or other phosphorus-containing compounds (e.g., organic compounds) which may produce a phosphorus-containing inorganic acid in situ.

What is claimed is:

1. A lubricating oil composition comprising a major amount of a tolyltriazole and boron containing lubricating oil and an oxidation-resistant effective amount of a synergistic additive combination of:

(A) phosphoric acid; and (B) di-nonyl-diphenylamine.

2. The composition of claim 1, where the ratio of (B) to (A) is from 50:1 to 1:50.

3. The composition of claim 1, wherein the composition is an automatic transmission fluid.

4. A concentrate containing the additive combination of claim 1.

5. A method of improving the oxidation resistance of a lubricating oil composition by incorporating an effective amount of the additive combination of claim 1.

6. A lubricating oil composition comprising:

(1) a major amount of a lubricating oil having approximately an 80 neutral number;

(2) a succinimide dispersant;

(3) tolyltriazole;

(4) amide and ethoxylated amine friction modifiers;

(5) a viscosity modifier;

(6) an antifoamant; and (7) an oxidation-resistant effective amount of a synergistic additive combination of (A) phosphoric acid, and (B) di-nonyl-diphenylamine.

7. The lubricating oil of claim 6, further comprising boron.

8. The lubricating oil of claim 6, wherein the succinimide dispersant is borated.

9. A lubricating oil composition consisting essentially of:

(1) a major amount of a lubricating oil having approximately an 80 neutral number;

(2) a succinimide dispersant;

(3) tolyltriazole;

(4) amide and ethoxylated amine friction modifiers;

(5) a viscosity modifier;

(6) an antifoamant; and (7) an oxidation-resistant effective amount of a synergistic additive combination of (A) phosphoric acid, and (B) di-nonyl-diphenylamine.

10. A lubricating oil composition consisting essentially of:

(1) a major amount of a lubricating oil having approximately an 80 neutral number;

(2) a succinimide dispersant;

(3) tolyltriazole;

(4) amide and ethoxylated amine friction modifiers;

(5) a viscosity modifier;

(6) an antifoamant;

(7) boron; and (8) an oxidation-resistant effective amount of a synergistic additive combination of (A) phosphoric acid, and (B) di-nonyl-diphenylamine.

11. The composition of claim 10, wherein boron is present in the form of borated succinimide dispersants.

* * * * *